US011530556B2

(12) United States Patent
Ryu et al.

(10) Patent No.: US 11,530,556 B2
(45) Date of Patent: Dec. 20, 2022

(54) HAND GRIPPABLE INSIDE HANDLE

(71) Applicants: Hyundai Motor Company, Seoul (KR); KIA Motors Corporation, Seoul (KR)

(72) Inventors: Jae-Min Ryu, Seongnam-si (KR); Yong-Dae Seo, Seoul (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 856 days.

(21) Appl. No.: 16/156,144

(22) Filed: Oct. 10, 2018

(65) Prior Publication Data

US 2019/0153755 A1 May 23, 2019

(30) Foreign Application Priority Data

Nov. 21, 2017 (KR) ..... 10-2017-0155848

(51) Int. Cl.
*E05B 85/12* (2014.01)
*E05B 79/16* (2014.01)
*E05B 79/06* (2014.01)

(52) U.S. Cl.
CPC ..... *E05B 85/12* (2013.01); *E05B 79/06* (2013.01); *E05B 79/16* (2013.01); *E05Y 2900/531* (2013.01)

(58) Field of Classification Search
CPC ..... E05B 85/12; E05B 79/16; E05B 79/20; E05B 79/22; E05B 79/06; E05B 85/18; Y10T 292/57
See application file for complete search history.

(56) References Cited

U.S. PATENT DOCUMENTS 7,052,053 B2 * 5/2006 Hall ..... E05C 3/162 292/126
8,220,862 B2 * 7/2012 Kaita ..... B60J 5/0487 296/146.5
8,491,022 B2 * 7/2013 Liebel ..... E05B 65/0858 292/336.3
10,119,307 B2 * 11/2018 Sugimoto ..... E05B 79/08
2004/0144142 A1 * 7/2004 Dimig ..... E05B 83/36 70/208

(Continued)

FOREIGN PATENT DOCUMENTS

DE 102018210422 A1 * 1/2020 ..... E05B 15/0053
JP 05-044635 U 6/1993
JP 2005-306061 A 11/2005

(Continued)

*Primary Examiner* — Kristina R Fulton
*Assistant Examiner* — Noah Horowitz
(74) *Attorney, Agent, or Firm* — Lempia Summerfield Katz LLC

(57) ABSTRACT

The present disclosure provides a hand grippable inside handle. Some forms of the present disclosure may include an upper grip handle and a lower grip handle which are coupled to an inner side of a door of a vehicle, a grip type inside handle having an upper portion engaged with the upper grip handle and a lower portion engaged with the lower grip handle, and an inside handle rod installed inside the grip type inside handle and configured to pivot with the grip type inside handle about an axis in a length direction when the grip type inside handle is pivoted, thereby operating a latch device of the door.

8 Claims, 5 Drawing Sheets

(56) References Cited

U.S. PATENT DOCUMENTS

| | | | | |
|---|---|---|---|---|
| 2019/0169892 | A1* | 6/2019 | Min | E05B 79/20 |
| 2020/0181952 | A1* | 6/2020 | Velicanin | E05B 79/06 |

FOREIGN PATENT DOCUMENTS

| | | | |
|---|---|---|---|
| JP | 2014-001568 | A | 1/2014 |
| JP | 2016132950 | A | 7/2016 |
| JP | 2017-081227 | A | 5/2017 |
| KR | 0521884 | B1 | 10/2005 |
| KR | 20090062653 | A | 6/2009 |
| KR | 20170032978 | A | 3/2017 |
| KR | 1724920 | B1 | 4/2017 |

* cited by examiner

HAND GRIPPABLE INSIDE HANDLE

CROSS-REFERENCE TO RELATED APPLICATION

The present application is based on and claims the benefit of priority to Korean Patent Application No. 10-2017-0155848, filed on Nov. 21, 2017, which is incorporated herein by reference in its entirety.

FIELD

The present disclosure relates to an inside handle installed at a door trim for opening or closing a vehicle door.

BACKGROUND

The statements in this section merely provide background information related to the present disclosure and may not constitute prior art.

To open a door from an interior of a vehicle, a door inside handle on a door trim may be manipulated to have the door latch device lock or open the door.

A door grip handle is also installed on the door, allowing the door to pivot when pulled.

Since both the door inside handle and the door grip handle are on the door, there is less room to freely design the door trim.

To address the reduced freedom to design the door trim as well as the increase of production cost, the door grip handle should be omitted.

The contents described in this section are to help the understanding of the background of the present disclosure, and may include what is not previously known to a person of ordinary skill in the art to which the present disclosure pertains.

SUMMARY

The present disclosure provides a hand grippable inside handle capable of increasing the degree of design freedom and improving production cost competitiveness by integrating functions of a door inside handle and a door grip handle.

The present disclosure can be understood by the following description and become apparent with reference to some of the variations of the present disclosure. Also, it is obvious to those skilled in the art to which the present disclosure pertains that the advantages provided by the present disclosure can be realized by the means as claimed and combinations thereof.

In accordance with a form of the present disclosure, a hand grippable inside handle includes an upper grip handle and a lower grip handle, both coupled to an inner side of a vehicle door, a grip type inside handle having an upper portion engaged with the upper grip handle and a lower portion engaged with the lower grip handle, and an inside handle rod installed inside the grip type inside handle, configured to pivot with the grip type inside handle about an axis in a length direction when the grip type inside handle is pivoted, thereby operating a latch device of the door.

The grip type inside handle may include a grip housing forming a user graspable exterior appearance, and an inside housing coupled to an interior of the grip housing and pivotably coupled to the upper grip handle and the lower grip handle.

The inside handle rod may be supported on the inside housing to pivot with the inside housing when the inside handle rod is pivoted.

A grid structure for supporting the inside handle rod may be formed at the inside housing, and the inside handle rod may have a bent shape, supported on the grid structure.

An upper end of the inside handle rod may be inserted into the upper grip handle and be engaged with a link lever to which a door latch cable connected to the latch device is coupled, and the hand grippable inside handle may further include an inside handle bracket coupled to a door trim and configured to guide the link lever.

The inside handle bracket may be configured with upper and lower frames, each of which has a length in a horizontal direction, and a guide hole may be formed at each of the upper and lower frames.

A rod coupler with a rod insertion hole into which the inside handle rod is inserted may be formed at one side of the link lever, where each of upper and lower ends of the rod coupler may be configured as a stepped sliding portion having a narrow width, and the sliding portions may be inserted into the guide holes.

A distal end portion of the inside handle rod inserted into the rod insertion hole may be pivoted with a predetermined radius about a pivot axis of the grip housing when the grip housing is pivoted.

The stepped sliding portion of the link lever may be moved along the guide hole as the distal end portion of the inside handle rod is operated.

The hand grippable inside handle may further include a return spring coupled between the upper grip handle and the inside housing.

Further areas of applicability will become apparent from the description herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
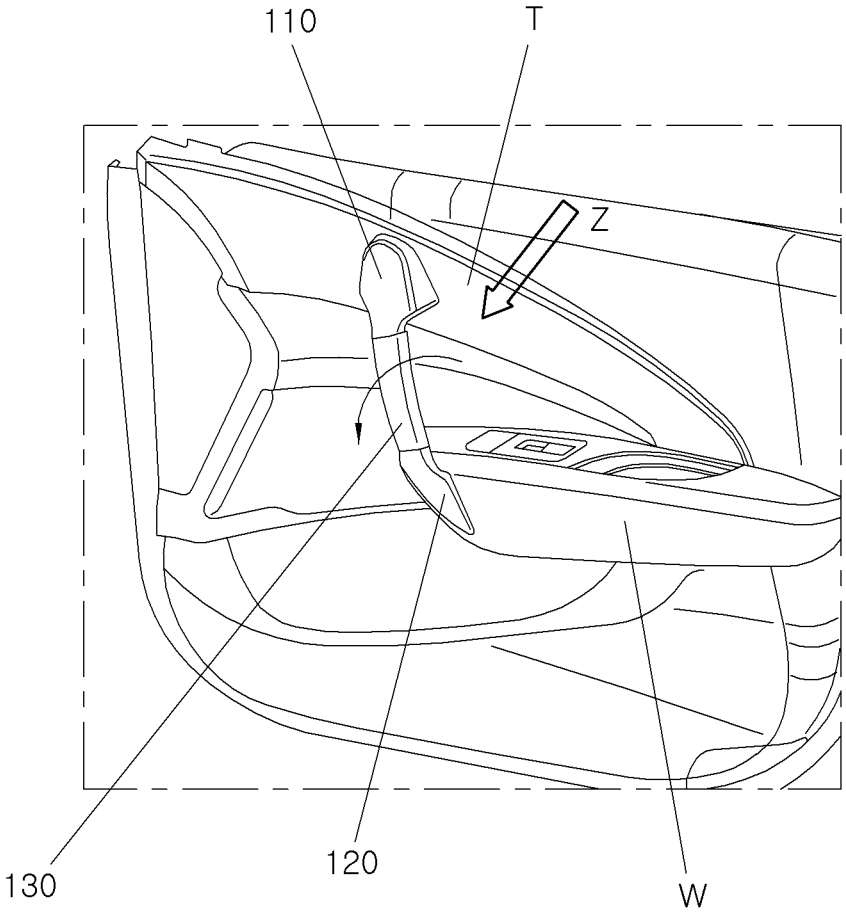
FIG. 1 is a diagram illustrating a hand grippable inside handle of the present disclosure, which is installed at a door.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Reference should be made to the accompanying drawings that illustrate exemplary forms of the present disclosure, and to the description in the accompanying drawings in order to fully understand the present disclosure and operational advantages of the present disclosure.

In certain variations, known technologies or detailed descriptions may be reduced or omitted to avoid obscuring appreciation of the disclosure by a person of ordinary skill in the art.

Figure 2:
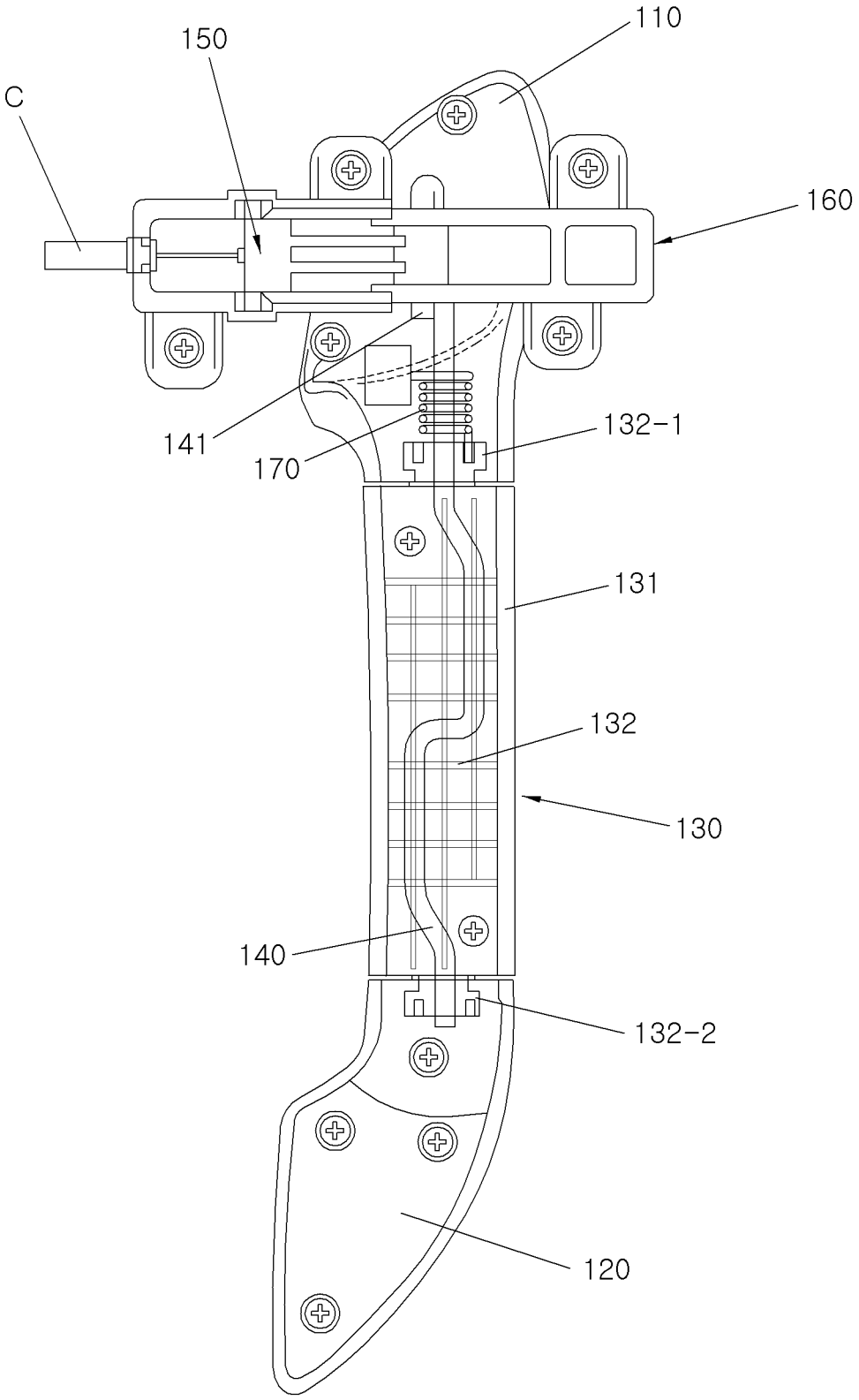
FIG. 2 is a diagram illustrating a hand grippable inside handle of the present disclosure when viewed from a Z-side of FIG. 1.
Figure 3:
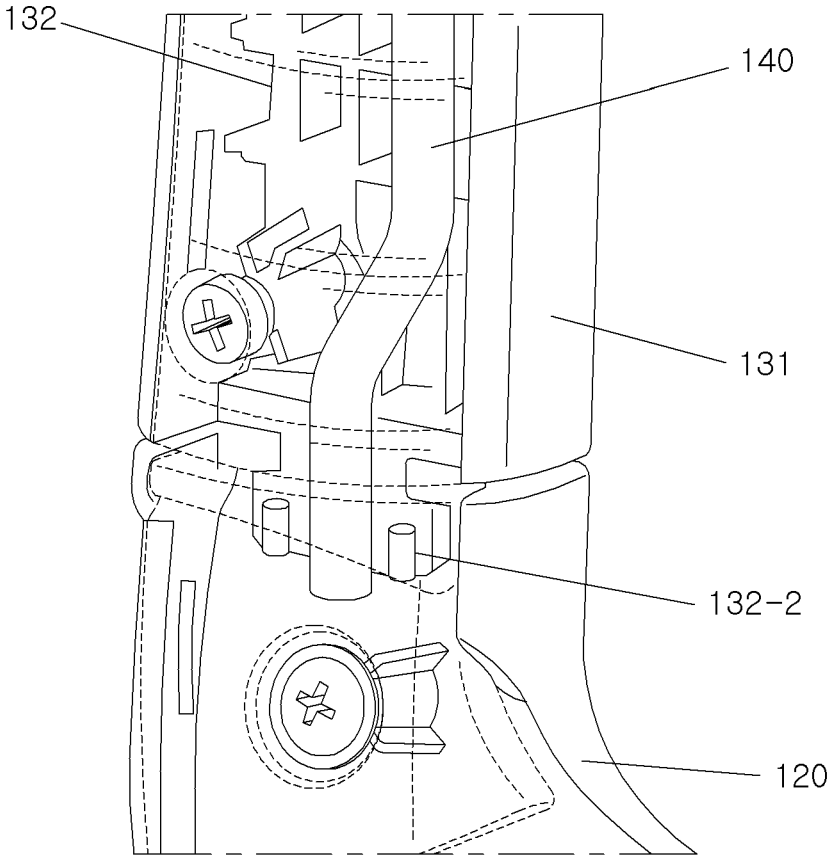
FIGS. 3 and 4 are diagrams illustrating a portion of the hand grippable inside handle of FIG. 2.
Figure 4:
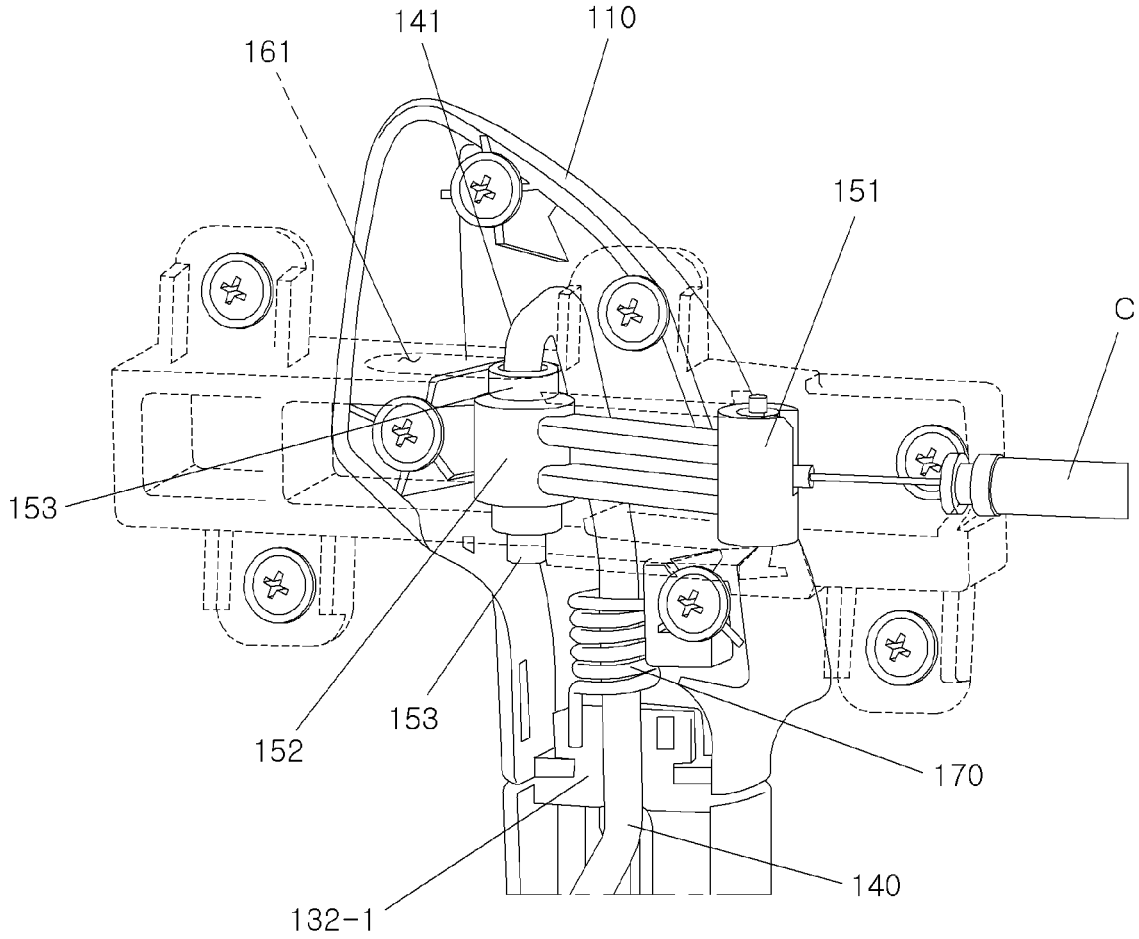

FIG. 1 is a diagram illustrating a hand grippable inside handle of the present disclosure, which is installed at a door. FIG. 2 is a diagram illustrating a hand grippable inside handle of the present disclosure when viewed from a Z-side of FIG. 1. FIGS. 3 and 4 are diagrams illustrating a portion of the hand grippable inside handle of FIG. 2.

Hereinafter, a hand grippable inside handle according to one form of the present disclosure will be described with reference to FIGS. 1 to 4.

The hand grippable inside handle according to one form of the present disclosure includes an upper grip handle 110, a lower grip handle 120, and a grip type inside handle 130.

The upper grip handle 110 is installed at a door trim T by bolting or the like, and the lower grip handle 120 is installed at an armrest W by bolting or the like.

Further, the grip type inside handle 130 is coupled between the upper grip handle 110 and the lower grip handle 120, and as shown in FIGS. 1 and 2, the grip type inside handle 130 is configured such that a user may grasp the grip type inside handle 130 by a hand to perform a pivoting operation.

As described above, the hand grippable inside handle of the present disclosure is configured and installed at a side surface of a door facing an interior of a vehicle, and thus the hand grippable inside handle serves as a conventional door grip handle for pulling or pushing the door, as well as for opening or closing the door by pivoting the grip type inside handle 130 and manipulating a door latch device connected to the grip type inside handle 130.

The grip type inside handle 130 includes a grip housing 131forming a user graspable exterior appearance, and an inside housing 132 provided inside the grip housing 131, coupled to the upper grip handle 110 and the lower grip handle 120, and configured to an inside handle rod 140.

The inside housing 132 is engaged with the grip housing 131 to pivot with the grip housing 131.

An upper engagement part 132-1 is formed at an upper end of the inside housing 132, and a lower engagement part 132-2 is formed at a lower end of the inside housing 132, such that the inside housing 132 is coupled to the upper grip handle 110 and the lower grip handle 120.

The upper engagement part 132-1 and the lower engagement part 132-2 are respectively inserted into a coupling hole formed at a lower end of the upper grip handle 110 and a coupling hole formed at an upper end of the lower grip handle 120.

Distal end portions of the upper engagement part 132-1 and the lower engagement part 132-2 are provided to have diameters larger than diameters of portions thereof engaged with and fixed to the upper grip handle 110 and the lower grip handle 120 by passing through the coupling holes of the upper grip handle 110 and the lower grip handle 120, such that the grip type inside handle 130 is configured to pivot between the upper grip handle 110 and the lower grip handle 120.

The inside housing 132 is configured such that a protruding grid structure is formed at a flat plate, and thus the inside handle rod 140 is confined by the protruding grid structure, such that the inside handle rod 140 is pivoted with the inside housing 132 when the inside housing 132 is pivoted.

Further, as shown in FIGS. 2, 3, and 4, the inside handle rod 140 may have a shape, bent more than once, to be stably supported on the inside housing 132.

The inside handle rod 140 is configured such that a lower end of the rod is inserted into the lower engagement part 132-2 of the inside housing 132, a portion of the lower end thereof is inserted into and coupled to the lower grip handle 120, and an upper end of the rod passes through the upper engagement part 132-1 of the inside housing 132 to extend to the upper grip handle 110.

The upper end of the inside handle rod 140 is engaged with a link lever 150, and the inside handle rod 140 is pivoted to operate the link lever 150, which is connected to a door latch cable C that operates a door latch device.

For the operation of the link lever 150 and a stable engagement of the link lever 150 with the door latch cable C, an inside handle bracket 160 is configured at a height corresponding to the upper grip handle 110 in an inner space of the door trim T.

The inside handle bracket 160 is installed at the door trim T and is configured with upper and lower frames, each of which has a length in a horizontal direction, and one surface of the inside handle bracket 160 corresponding to a rear side from an inner side of the vehicle (a front surface in FIG. 4) is open to be provided in the form in which the link lever 150 is operable, and a hole through which the door latch cable C may pass is formed at one side surface of the inside handle bracket 160.

A guide hole 161 is formed at each of the upper and lower frames at a predetermined distance to guide a movement of the link lever 150.

A cylindrical latch coupler 151 is formed at one side of the link lever 150 and is coupled to the door latch cable C, and a cylindrical rod coupler 152 is formed at the other opposite side of the link lever 150 and is coupled to the inside handle rod 140.

Further, each of upper and lower ends of the rod coupler 152 is configured as a sliding portion having a width that is narrower than that of an intermediate end of the rod coupler 152 and having a stepped shape. The upper and lower sliding portions are respectively inserted into the guide holes 161 of the inside handle bracket 160 to slide at the guide holes 161.

Furthermore, a rod insertion hole is formed to vertically pass through the cylindrical rod coupler 152, and the inside handle rod 140 is inserted into the rod insertion hole, such that a position of the link lever 150 is determined by the inside handle rod 140.

The upper end portion of the inside handle rod 140 is bent at more than two points to form a ring shape, and a last bent distal end portion 153 is inserted, as a lever insertion end 141, into the rod insertion hole formed at the rod coupler 152 of the link lever 150.

With this configuration, the lever insertion end 141 is not pivoted in place but is pivoted in an arc about a pivot axis of the grip housing 131.

Therefore, the lever insertion end 141 is moved on the guide holes 161 formed at the upper and lower frames of the inside handle bracket 160, and thus a position of the link lever 150 may be changed.

A return spring 170 is coupled between the upper grip handle 110 and the upper engagement part 132-1.

Thus, when the grip type inside handle 130 is pivoted, the upper grip handle 110 is fixed while the upper engagement part 132-1 is pivoted, thereby deforming the return spring 170 and generating an elastic restoring force.

When a user releases an external force applied to the grip type inside handle 130, the grip type inside handle 130 returns to its original position due to the elastic restoring force of the return spring 170.

Figure 5:
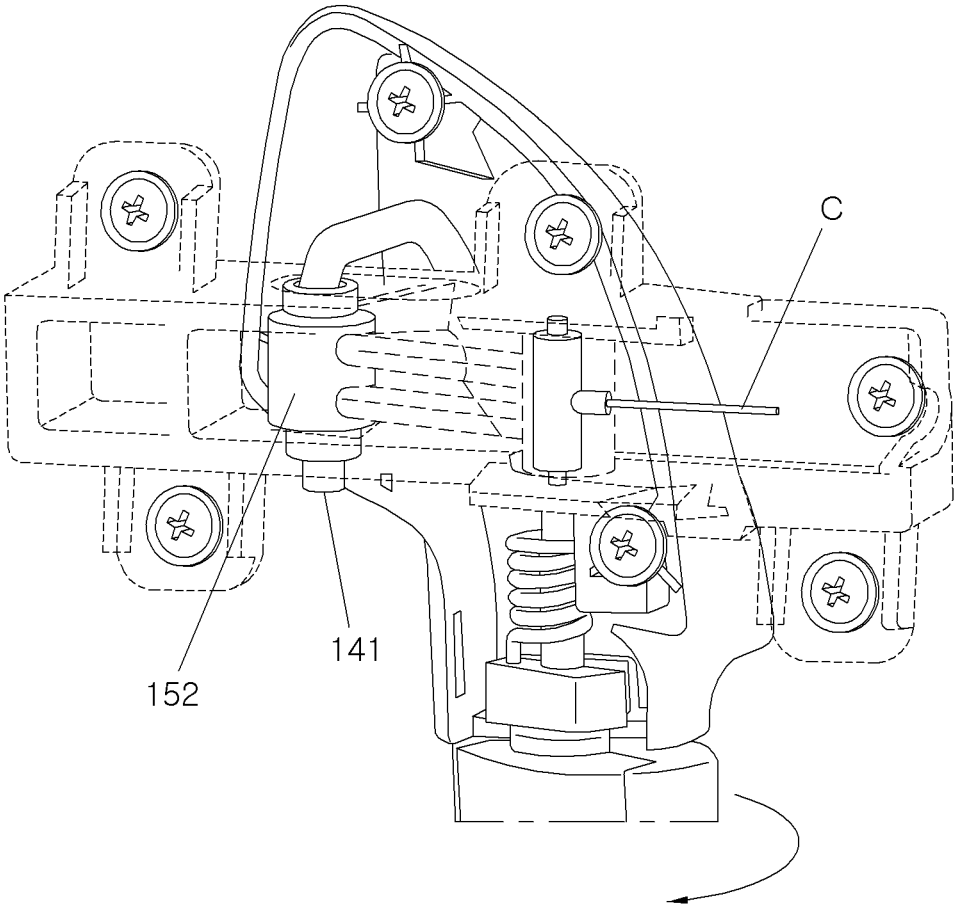
FIG. 5 is a diagram illustrating an operation state of the hand grippable inside handle of the present disclosure on the basis of FIG. 4.

FIG. 5 illustrates a state in which the grip type inside handle 130 is pivoted to compress the return spring 170, and when the inside handle rod 140 is pivoted with the inside housing 132 the lever insertion end 141 of the inside handle rod 140 is moved along the guide holes 161 of the inside handle bracket 160.

Accordingly, the link lever 150 is pulled and the door latch cable C connected to the latch coupler 151 of the link lever 150 is pulled such that the door latch device releases a door locking.

As described above, a hand grippable inside handle according to the present disclosure is configured such that a grip type inside handle serves as a conventional door grip handle as well as operates a door latch device for opening or closing a door through a manipulation operation, thereby providing greater options for designing a door trim while reducing the production cost.

Moreover, in the case of the conventional door inner handle, there is a probability that a door latch device is released and thus the door is opened even when an impact is applied to the door. With the present disclosure even when the impact is applied to the door, the hand grippable inside handle is not easily manipulated by the impact, such that the door is inhibited from opening by itself and thus it can be safer when a vehicle accident occurs.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A hand grippable inside handle, comprising:

an upper grip handle and a lower grip handle, both coupled to an inner side of a door of a vehicle;

a grip inside handle including:

an upper portion engaged with the upper grip handle, a lower portion engaged with the lower grip handle, and a grip housing forming a user graspable exterior appearance and an inner space; and an inside handle rod installed in the inner space of the grip housing and configured to be rotated with the grip housing, wherein the grip housing is rotated on an axis penetrating the inner space of the grip housing along a longitudinal direction of the grip housing, wherein the rotation of the grip inside handle causes a movement along a substantially straight line of an upper end of the inside handle rod, such that a latch device of the door operates, wherein:

the upper end of the inside handle rod is inserted into the upper grip handle and is engaged with a link lever to which a door latch cable connected to the latch device is coupled; and the hand grippable inside handle further includes an inside handle bracket coupled to a door trim and configured to guide the link lever, and wherein:

a rod coupler with a rod insertion hole configured to receive the inside handle rod is formed at one side of the link lever; and each of upper and lower ends of the rod coupler is configured as a stepped sliding portion having a narrow width, and the sliding portions are inserted into guide holes formed in the inside handle bracket.

2. The hand grippable inside handle of claim 1, wherein the grip inside handle includes:

an inside housing coupled to an interior of the grip housing and rotatably coupled to the upper grip handle and the lower grip handle.

3. The hand grippable inside handle of claim 2, wherein the inside handle rod is supported on the inside housing to rotate with the inside housing when rotating the inside handle rod.

4. The hand grippable inside handle of claim 3, wherein:

a grid structure for supporting the inside handle rod is formed at the inside housing; and the inside handle rod has a bent shape and is supported on the grid structure.

5. The hand grippable inside handle of claim 1, wherein the inside handle bracket includes an upper frame and a lower frame, each of which has a length in a horizontal direction, and the guide holes are respectively formed at the upper and lower frames.

6. The hand grippable inside handle of claim 1, wherein a distal end portion of the inside handle rod inserted into the rod insertion hole is rotated with a predetermined radius about a rotation axis of the grip housing when the grip housing is rotated.

7. The hand grippable inside handle of claim 6, wherein the stepped sliding portion of the link lever is moved along the guide hole as the distal end portion of the inside handle rod is operated.

8. The hand grippable inside handle of claim 2, further comprising:

a return spring coupled between the upper grip handle and the inside housing.

* * * * *